United States Patent [19]
LeVeen
[11] 4,294,360
[45] Oct. 13, 1981

[54] STERILE ARTICLE CONTAINER WITH STERILE OPENING EDGE PORTIONS

[76] Inventor: Harry H. LeVeen, 321 Confederate Cir., Charleston, S.C. 29407

[21] Appl. No.: 65,924

[22] Filed: Aug. 13, 1979

[51] Int. Cl.[3] ..... B65D 75/58; B65D 77/38
[52] U.S. Cl. ..... 206/438; 206/602; 206/627
[58] Field of Search ..... 206/438, 440, 441, 484, 206/602, 623, 627, 630, 264; 229/87 F, 87 C, 3.5 MF

[56] References Cited

U.S. PATENT DOCUMENTS 2,078,227 4/1937 Blum ..... 206/264
2,296,830 9/1942 Beals ..... 229/87 C
2,296,951 9/1942 Rosen et al. ..... 206/602
2,949,370 8/1960 Hughes ..... 229/87 F
2,992,119 7/1961 Gapinski ..... 229/87 F
3,286,832 11/1966 Pilger ..... 229/3.5 MF
3,941,245 3/1976 Oliverias ..... 206/438

*Primary Examiner*—William T. Dixson, Jr.
*Attorney, Agent, or Firm*—Brooks, Haidt, Haffner & Delahunty

[57] ABSTRACT

A container for retaining an article in sterile condition in which the container has a weakened tear line located on an infolded portion of the container wall. When the container is opened along the tear line, the edges around the opening through which the article is withdrawn are sterile.

9 Claims, 10 Drawing Figures

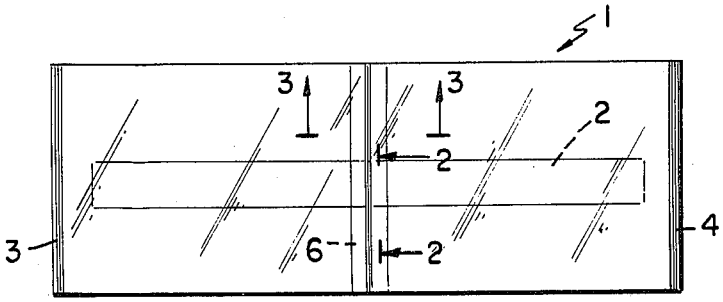
FIG. 1
FIG. 2
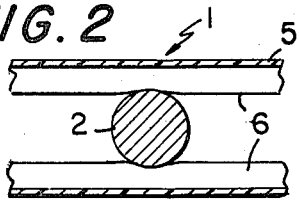
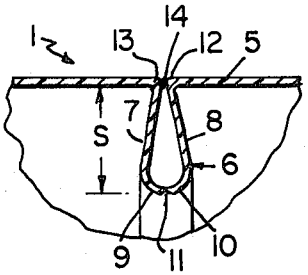
FIG. 3
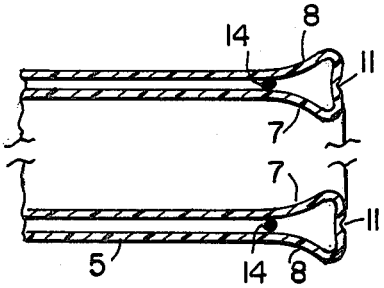
FIG. 4
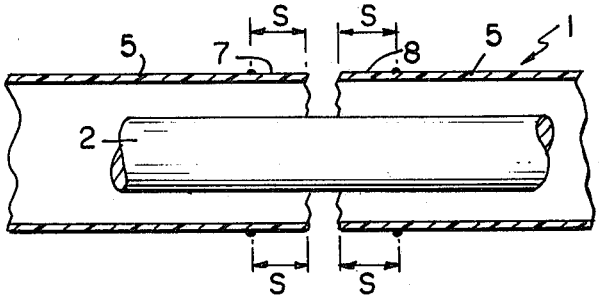
FIG. 5
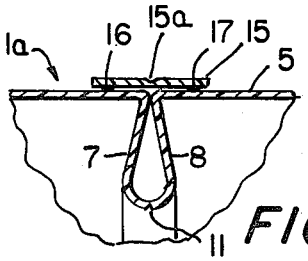
FIG. 6
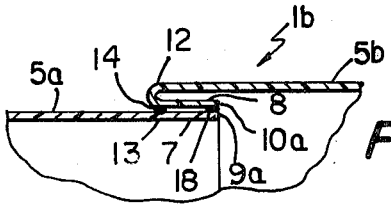
FIG. 7
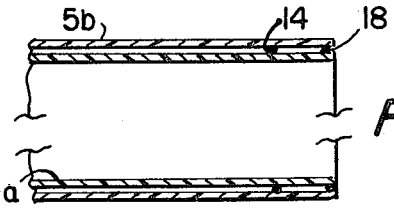
FIG. 8
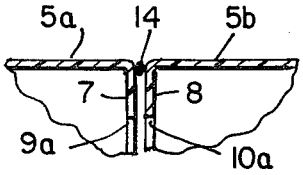
FIG. 9
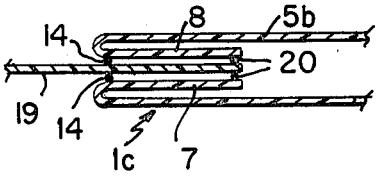
FIG. 10

STERILE ARTICLE CONTAINER WITH STERILE OPENING EDGE PORTIONS

The present invention relates to packaging and in particular provides a container for retaining an article in sterile condition and which is designed to prevent contamination of the sterile article by contact with the unsterile exterior of the container when the article is removed from the container.

It is well known in the art to package sterile articles, such as surgical devices, in containers which retain the article in a sterile environment until the package is opened. For example, it is known to place such devices in a bag or tube of a plastic material, e.g. a film made of a cellulosic material, or a porous spun polyethylene film sold under the trademark TYVEK, and after sealing the bag or tube, to sterilize the bag or tube and its contents by exposure to ethylene oxide gas, steam or radiation. Combinations of a plastic material and paper have also been used for such containers, and usually, the containers have a seal which can be manually opened by pealing through a weakened tear line. In rare cases a portion of the container is cut off.

The problem with peal packages is that the edge where the sterile interior of the package meets the outside world is always unsterile, and inadvertant touching of the sterile object during its removal from the package will contaminate it. The present invention presents a solution to this problem.

Such devices and the interior of such containers remain sterile during storage and handling thereof, but the exterior of the container becomes contaminated, and is no longer sterile. In order to use the device, it must be removed from the container, and with prior art containers, it is difficult to remove the sterile object without contaminating it by touching an unsterile portion, such that the edges at the cut or tear made to permit removal of the device. It is, of course, possible to again sterilize the exterior of the container before opening it, and if the container is to be cut, to use a sterilized cutting instrument. However, this is inconvenient, costly, time consuming and not standard practice. It has also been the practice to package the device in two containers, one within the other and everything within the outer container being sterile, and to first open only the outer container and dump the inner container with the device on a sterile surface, for example, a sterile operating table, and then, open the inner container under sterile conditions. This solution is also not satisfactory, not only because the inner container can become contaminated as it passes out of the outer container, and touches the edge of the outer container which is unsterile. Also, a double container is more expensive. In addition, it is difficult for someone wearing sterile rubber gloves to remove the sterile device from the container by grasping only the device without touching the unsterile edge. The inner container may become contaminated during the opening thereof or its discharge from the outer container.

One object of the invention is to provide a simple and inexpensive, single wall container which can be opened and from which a sterile article can be removed without touching the article on the unsterile edge of the container.

In accordance with the preferred embodiment of the invention, a tube of a flexible plastic material is made which has a weakened tear line somewhere between its opposite ends, and preferably about mid-way between its opposite ends when the tubing is unfolded to include portions adjacent to and on opposite sides of such line turned inwardly of the tube. Longitudinally opposite ends of the portions are brought together and sealed with a seal which will prevent passage of contaminant but which can be opened by manual forces exerted on the opposite ends of the tube in a direction away from the seal. Continued application of such forces then separates the tube into two parts along the line of weakening. However, when the article is inserted into the tube, the ends of the tube are closed and the article and the tube are sterilized, said portions within the tube are also sterilized and remain within the sterile tubular container during handling and storage. When the container is opened as described, the edge portion of the container where the article is removed is the infolded sterile portion of the tube. Therefore, contamination of the article by contact with an unsterile edge of the container is avoided.

Other objects and advantages of the present invention will be apparent from the following detailed description of the presently preferred embodiments thereof, which description should be considered in conjunction with the accompanying drawings in which:

FIG. 1 is a plan view of the preferred embodiment of the container of the invention with an article therein;

FIG. 2 is an enlarged, cross-sectional view of a portion of the container illustrated in FIG. 1 and is taken along the line 2—2 indicated in FIG. 1;

FIG. 3 is an enlarged, cross-sectional view of a portion of the container illustrated in FIG. 1 and is taken along the line 3—3 indicated in FIG. 1;

FIG. 4 illustrates a step in one method of manufacturing the container illustrated in FIG. 1;

FIG. 5 illustrates the opening of the container illustrated in FIG. 1 for the purpose of removing an article therein;

FIG. 6 is an enlarged, cross-sectional view, similar to FIG. 3, but illustrating the use of a strip of film impenetrable to contaminants to provide a peripheral seal for the container;

FIG. 7 is an enlarged, cross-sectional view, similar to FIG. 3, of a modified embodiment of the container of the invention;

FIG. 8 is similar to FIG. 4, and illustrates a step in one method of manufacturing the container illustrated in FIG. 7;

FIG. 9 is an enlarged, cross-sectional view, similar to FIG. 3, of a modified embodiment of the container of the invention; and FIG. 10 is a cross-sectional view of a further embodiment of the container of the invention.

The container 1 illustrated in FIG. 1 has the shape of a flattened tube which contains an article 2 which it is desired to keep sterile. The container is sealed at its longitudinally opposite ends 3 and 4 in any conventional manner which will prevent contaminant from entering the container 1 at its ends 3 and 4.

The container 1 is made from any well-known type of barrier film impenetrable to contaminants, such as a thermoplastic resin, a cellulose film, or a spun polyethylene film sold under the trademark TYVEK. If the container 1 is to be sterilized interiorly with ethylene oxide gas after sealing, the material selected for the container 1 must be penetrable by such vapors. Preferably, the material is transparent, or semi-transparent, is heat sealable, and is flexible. Since the material is heat sealable, the container 1 can be sealed at its ends 3 and 4 by heat.

In the preferred embodiment of the invention, a section of the tubular wall 5 of the container 1, preferably a section about midway of the length of the container, is folded inwardly of the tube to form a circumferentially extending fold 6 which is bight-shaped in cross-section (FIG. 3). Thus, the fold 6 comprises two circumferentially extending portions 7 and 8 which extend inwardly of the tube and which are extensions of tube wall 5. Since the fold 6 is formed by a loop or bight of the material of the tube wall 5, the innermost ends 9 and 10 of the portions 7 and 8 are integral with each other and prevent the entrance of contaminants into the interior of the container between the portions 7 and 8. A line of weakening 11 is provided at the juncture of the portions 7 and 8 for purposes hereinafter described.

The outermost ends 12 and 13 of the portions 7 and 8 are sealed together at the periphery of the tubular wall 5 by a seal 14 which prevents the entry of contaminants into the space between the portions 7 and 8. If the material of the wall 5 is heat sealable, the seal 14 can be a heat seal. For purposes hereinafter described, the seal 14 is selected so that it will part before the material of the wall 5 tears when oppositely directed forces are applied to the ends 3 and 4 to open the container 1.

A method for making the fold 6 and the seal 14 is illustrated in FIG. 4. Thus, a tube of the material of the wall 5 with a line of weakening 11 is turned back upon itself until the two parts of the tube have the positions shown in FIG. 4 and then, the adjacent parts are heat sealed at 14 to provide the bight-shaped fold having the portions 7 and 8 with an intermediate line of weakening 11. The outer part of the tube is then pulled to the right, in the manner that a stocking is pulled from a leg, to provide the structure shown in FIG. 3. Of course, other methods for making the structure in FIG. 3 may be used.

After the tube with the fold 6 is formed, an article 2 is inserted into the interior of the wall 5, either before or after one of the ends 3 or 4 is closed. Thereafter, any ends 3 and 4 not previously closed are closed, and the container 1 with the article 2 therein is sterilized, such as by heat, radiation or ethylene oxide vapors. When the container 1 is later handled or stored, the exterior thereof can become contaminated, but the interior thereof, the article 2 and the portions 7 and 8 will remain sterile.

When it is desired to remove the article 2 from the container 1, the container 1 is grasped at its ends 3 and 4, and oppositely directed forces, which pull the ends 3 and 4 apart, are applied thereto until the seal 14 breaks or parts and the portions 7 and 8 separate along the line of weakening 11. The line of weakening 11 is, of course, formed in a known manner so that the portions 7 and 8 will separate along such line 11 before the material of the wall 5 tears elsewhere.

During the pulling of the ends 3 and 4 apart, the portions 7 and 8 are rotated around their outermost ends after the seal 14 parts so that they will move from their positions shown in FIG. 3 to positions generally aligned with the wall 5. Thus, as shown in FIG. 5, the portion 7 can be aligned with the wall 5 of one half of the container 1 and the portion 8 can be aligned with the wall 5 of the other half of the container 1. Since the portions 7 and 8 were sterile prior to the opening of the container 1, such portions, which extend for the distance S at the open edges of the container 1, will remain sterile at least for the time required to remove the article 2 from the container 1. Therefore, contact of the article 2 with the portions 7 or 8 will not render the article 2 unsterile.

Although the embodiment of the container 1 illustrated in FIGS. 1–5 has been described as being formed from an open ended tube which requires seals at the ends 3 and 4, it will be apparent that the container 1 can be formed from a tubular bag having one end closed in any desired manner, and in this case, it will be necessary to seal only the open end of the bag after the article 2 is placed therein.

In the modified form of the container illustrated in FIG. 6 the peripheral seal 14 is replaced by a strip 15 which encircles the container **1*a* and overlies the outermost ends of the portions 7 and 8. The material of the strip 15 can be any material which is impenetrable to comtaminants and which can be sealed to the wall 5. The material of the strip 15 can, for example, be the same as the material of the wall 5 and can be heat sealed to the wall 5 along the peripherally extending lines 16 and 17 or can be of a different material and be otherwise sealed to the wall 5 along the lines 16 and 17. The seals along the lines 16 and 17 must be such that a least one of them will break or part before the wall 5 tears during the opening of the container 1*a*, or alternatively, the material of the strip 15 must tear before the wall 5 tears during opening. For the latter purpose, the strip 15 can be provided with a line of weakening 15*a***.

A further embodiment of the container of the invention is illustrated in FIG. 7. The container **1*b* shown in FIG. 7 differs from the containers previously described in that the portions 7 and 8 are not integral with each other at their innermost ends 9*a* and 10*a* even though they are sealed together along a circumferentially extending line 18. The seal at 18 must part before the wall 5 tears during the opening of the container 1*b*, but while such seal preferably is one which is impenetrable to contaminants it is not necessarily such a seal since the interior of the container 1*b* will remain sterile as long as the peripheral seal 14 between the outermost ends 12 and 13 of the portions 7 and 8 is contamination impenetrable. As with the embodiment shown in FIGS. 1–5, the seal 15 must part before the tubes 5*a* and 5*b* tear during the opening of the container 1*b***.

The container **1*b* can be made in the manner described in connection with FIG. 4, and one step thereof is illustrated in FIG. 8. Thus, a tube 5*b* is placed around a tube or tubular bag 5*a*, and they are sealed together at 14 and 18. Thereafter, the tube 5*b* is pulled to the right, as viewed in FIG. 8, and in the manner that a stocking is pulled from a leg, until the tubes 5*a* and 5*b* have the positions shown in FIG. 7. The container 1*b* can then be filled with an article 2**, sealed and sterilized as described in connection with the previous embodiments.

As mentioned in connection with the embodiment of the container illustrated in FIG. 7, it is not necessary that the seal along the line 18 be impenetrable to comtaminants, even though it is desirable to make doubly sure that comtaminants will not enter the container **1*b*. In fact, if a seal 14 can be relied upon to prevent the entrance of contaminants into the container 1*b*, the seal along the line 18 can be omitted between the innermost ends of the portions 7 and 8 as illustrated in FIG. 9. However, it will also be noted that with the structure shown in FIG. 9, the portions 7 and 8 will not be pulled into alignment, respectively, with the tubes 5*a* and 5*b* during the opening of the container because of the lack of a seal along the line 18**, and this may be undesirable in some cases.

In each of the various embodiments of the invention, including the one described hereinafter, it is preferred that the entire container be inside a material which is flexible enough to permit the bending required to provide the portions 7 and 8 without destroying the ability of the wall of the container to prevent the entrance of contaminants. However, it will be apparent that it is necessary to have the container so flexible only where the portions 7 and 8 are provided.

In the preferred embodiments of the invention, the inwardly extending portions 7 and 8 are located about centrally of the ends 3 and 4 of the container. However, it may be desirable in some cases to locate the portions 7 and 8 nearer one end, 3 or 4, than the other end. Also, it is possible to locate the portions 7 and 8 so that there is a tubular portion at only one side of the seal at the outermost ends of the portions 7 and 8.

As illustrated in FIG. 10, the principles of the invention can be applied when the opening portion of the container 1*c* has a tube 5*b* at one side of the seal 14 at the outermost ends of the portions 7 and 8, and an opening or removal strip 19 intermediate and sealed to the portions 7 and 8 by the seal 14 and a seal 20. While the portions 7 and 8 are intermediate the extreme ends of the container 1*c* in the embodiment shown in FIG. 10, there is a tube 5*b* at only one side of the seal 14. When the tube 5*b* is held and the strip 19 is pulled, the seal 14 parts first, the portions 7 and 8 are pulled outwardly of the tube 5*b* and then, the seal 20 parts leaving sterile portions 7 and 8 at the open end of the tube 5*b*. As with the previously described embodiments, the seal 20 can be omitted if the seal 14 is sufficiently reliable with respect to the prevention of the entrance of contaminants into the interior of the tube 5*b*.

Although preferred embodiments of the present invention have been described and illustrated, it will be apparent to those skilled in the art that various modifications may be made without departing from the principles of the invention.

I claim:

1. A container for a sterile article, said container comprising a tube of material inpenetratable to contaminants, a pair of adjacent portions of said tube extending into the interior of said tube, a seal joining the outermost ends of said portions about the periphery of each thereof, said seal being inpenetrable to contaminants forming a contamination barrier whereby both surfaces of each said portion lie within said tube inside such barrier, and said seal being separable upon manual forces applied to said container at the ends thereof in a direction which moves said ends apart, the innermost ends of said portions being separable without tearing said tube at other than said innermost ends by continued application of said forces whereby said container is opened providing edges about the openings formed by said innermost ends of said portions with the surfaces of said portions on both sides of said edges being those surfaces retained inside of said contamination barrier prior to opening said container.

2. A container as set forth in claim 1 wherein said portions are formed by a fold of the material of said tube intermediate its ends whereby the innermost ends of said portions are joined together and prevent the entry of contaminants into said tube between said portions, and wherein there is a circumferential line of weakening at or adjacent said innermost ends.

3. A container as set forth in claim 1 or 2 wherein the material of said tube is a flexible thermoplastic material.

4. A container as set forth in claim 3 wherein said portions are secured together at the periphery of said tube by heat sealing.

5. A container as set forth in claim 1 or 2 wherein said portions are secured together at the periphery of said tube by a peripherally extending strip secured to said tube and overlying the outermost ends of said portions.

6. A container as set forth in claim 1 wherein said portions are sealed together at their innermost ends.

7. A container as set forth in claim 1 wherein said longitudinally opposite ends of said container are closed to prevent the entrance of contaminants into said tube at said opposite ends and wherein said portions and the interior of said tube are sterile.

8. A container as set forth in claim 1 wherein there is an opening strip between said portions and said seal comprises said strip which is sealed to said outermost ends.

9. A container as set forth in claim 8 wherein said innermost ends of said portions are sealed to said strip.

* * * * *